US006220357B1

(12) United States Patent
Carmichael et al.

(10) Patent No.: US 6,220,357 B1
(45) **Date of Patent: *Apr. 24, 2001**

(54) DOWNHOLE FLOW CONTROL TOOL

(75) Inventors: Mark Carmichael, Aboyne; Paul Howlett, Cults, both of (GB)

(73) Assignee: Specialised Petroleum Services Ltd., Westhill Aberdeenshire (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/116,751

(22) Filed: Jul. 16, 1998

(30) Foreign Application Priority Data

Jul. 17, 1997 (GB) ..... 9715001

(51) Int. Cl.[7] ..... E21B 34/10
(52) U.S. Cl. ..... 166/321; 166/227; 166/240
(58) Field of Search ..... 166/321, 319, 166/240, 331, 386, 369, 227

(56) References Cited

U.S. PATENT DOCUMENTS

| | | | | |
|---|---|---|---|---|
| 4,113,012 | * | 9/1978 | Evans et al. | 166/264 |
| 4,403,659 | * | 9/1983 | Upchurch | 166/374 |
| 4,915,175 | * | 4/1990 | Marshaw, Jr. | 166/332 |
| 5,010,955 | * | 4/1991 | Springer | 166/298 |
| 5,295,538 | * | 3/1994 | Restarick | 166/205 |
| 5,377,750 | * | 1/1995 | Arterbury et al. | 166/205 |
| 5,609,178 | * | 3/1997 | Hennig et al. | 137/10 |
| 5,609,204 | * | 3/1997 | Rebardi et al. | 166/51 |
| 5,730,223 | * | 3/1998 | Restarick | 166/380 |
| 5,890,540 | * | 4/1999 | Pia et al. | 166/321 |
| 5,901,796 | * | 5/1999 | McDonald | 175/57 |

FOREIGN PATENT DOCUMENTS

| | | |
|---|---|---|
| 0 786 577 | 7/1997 | (GB) . |
| 0 802 304 | 10/1997 | (GB) . |
| 2 315 082 | 1/1998 | (GB) . |
| WO 97/47850 | 12/1997 | (WO) . |

* cited by examiner

*Primary Examiner*—Hoang Dang
(74) *Attorney, Agent, or Firm*—Clifford W. Browning; Woodard, Emhardt, Naughton, Moriarty & McNett

(57) ABSTRACT

A downhole tool having selectively openable ports therein, the tool being actuable between a closed configuration in which the ports are closed, a primed configuration in which the ports are primed for opening, and an open configuration in which the ports are opened.

7 Claims, 17 Drawing Sheets

DOWNHOLE FLOW CONTROL TOOL

The invention relates to a downhole tool, and particularly relates to a downhole tool having ports therein which can be selectively opened and closed to permit and deny fluid to flow therethrough.

When drilling for oil and gas, in recent years it has been known to drill horizontally through the payzone of the formation, in order to maximise the production available from the well. The result of horizontal drilling is that there may be thousands of feet of production pipe located within the payzone. Conventional production pipe for horizontal wells consists of pre-perforated pipe which is run into the well with an inner string located within the pipe. Circulation of fluid through the inner string assists the placement of the pipe onto the bottom of the well. The inner string also allows the well to be cleaned after drilling by circulating cleaning fluids through the inner string. For this cleaning operation it is useful to have a high cleaning fluid circulation rate to give a turbulent cleaning action.

However, the employment of the inner string reduces the pressure of circulating fluid available because of the inner string's reduced internal diameter when compared to the diameter of the perforated pipe. Also, because the pipe is perforated, the cleaning fluid is circulated in the annulus between the inner string and the perforated pipe, as well as the annulus between the perforated pipe and the wellbore where it is actually required. Another disadvantage is that the cleaning fluid tends to fall to the lower half of the horizontal well, leaving the upper half relatively unwashed.

Where the oil and gas payzone is a sandy formation it is known to use a filter screen in order to prevent the sand from entering the inner bore of the production pipe. Conventional filter screens are either mounted on the outside of the perforated pipe along its length, and sealed at both ends thereto, or alternatively a rigid filter screen is used instead of a perforated pipe.

According to a first aspect of the invention, there is provided a downhole tool having selectively openable ports therein, the tool being actuable between a closed configuration in which the ports are closed, a primed configuration in which the ports are primed for opening, and an open configuration in which the ports are opened.

Preferably, the tool is actuable by downhole fluid pressure located within an inner bore of the downhole tool, and more preferably, the tool is actuable between the configurations by a variation in the downhole fluid pressure.

In a preferred embodiment, the downhole tool comprises a first body member, and a second body member which is concentric with the first body member.

The first aspect of the invention has the advantage that there is no fluid communication between the inner bore and the ports when the ports are closed, and when the ports are open there is fluid communication between the ports of both of the first and second body members and the inner bore.

According to a second aspect of the present invention, there is provided a downhole screen to filter production fluids, the screen comprising a filter portion, and selectively openable ports, the screen being actuable between a closed configuration in which the ports are closed, and an open configuration in which the ports are opened.

Preferably, the screen is actuable to a primed configuration in which the ports are primed for opening, the primed configuration occurring between the closed and open configurations.

Preferably, the screen is actuable by down downhole fluid pressure located within an inner bore of the screen, and more preferably, the screen is actuable between the configurations by a variation in the downhole fluid pressure.

In a preferred embodiment, the screen comprises a first body member and a second body member, the screen being coupled to one of the first or second body members.

Preferably, the first and second body members have at least one port therein, and more preferably, the first body member is movable with respect to the second body member from the closed configuration to the primed configuration to the open configuration.

The second aspect of the invention has the advantage that when the ports are closed there is no production fluid flow permitted from the filter portion to the inner bore, and when the ports are open production fluid flow is permitted from the filter portion through the ports and into the inner bore.

Preferably, a first movement means is provided to move the first body member from the closed to the primed configuration, and preferably, a second movement means is provided to move the first body member from the primed to the open configuration.

Preferably, the first body member is initially locked in the closed configuration by a selective locking device. More preferably, the selective locking device is a shear pin.

Typically, the first movement means is actuated by increasing the pressure of fluid located within the inner bore. Preferably, the first body member has a smaller internal diameter than the second body member, and more preferably, the fluid pressure acts upon the first body member and unlocks the selective locking device.

Typically, the second movement means is actuated by reducing the pressure of fluid located within the inner bore. Preferably, the second movement means comprises a biassing device, and more preferably, the second movement means is adapted to move the first body member in an opposite direction to the direction in which the first movement means is adapted to move the first body member.

Preferably, the first body member is a movable sleeve.

The second body member may be a body. Alternatively, the second body member is a cylinder which is preferably connected to a port in the side wall of a casing tubular.

The first or second body members may comprise a second locking device to lock the first body member in the third configuration.

Preferably, the first body member is formed from a dissolvable material, which may be dissolved by a suitable material which may be an acid solution.

Preferably, the first and second body members each comprise a respective shoulder which make contact to restrict the movement therebetween at the primed configuration, when the first body member is moved from the closed to the primed configuration.

According to a third aspect of the present invention there is provided a method of opening the ports of a downhole tool, the method comprising increasing the pressure of fluid contained within an inner bore of the downhole tool, and subsequently decreasing the pressure of the fluid contained within the inner bore.

According to a fourth aspect of the present invention there is provided a method of opening the ports in a screen, the method comprising increasing the pressure of fluid contained within an inner bore of the screen, and subsequently decreasing the pressure of the fluid contained within the inner bore.

Embodiments of the invention will now be described, by way of example only, with reference to the accompanying drawings in which:

FIG. 1. is a three-quarter sectioned side view of a first example of a downhole tool included in a screen, where the tool is in a locked and closed configuration;

FIGS. 1 to 6 show a downhole tool 10 in accordance with a first aspect of the invention, which is incorporated into a screen 5 for inclusion in a production string and insertion into an oil or gas payzone. It is envisaged that a plurality of downhole tools 10 would be included along the length of the production string. However, it should be noted that the screen 5 would normally only be included where the formation is sandy.

Figure 1:
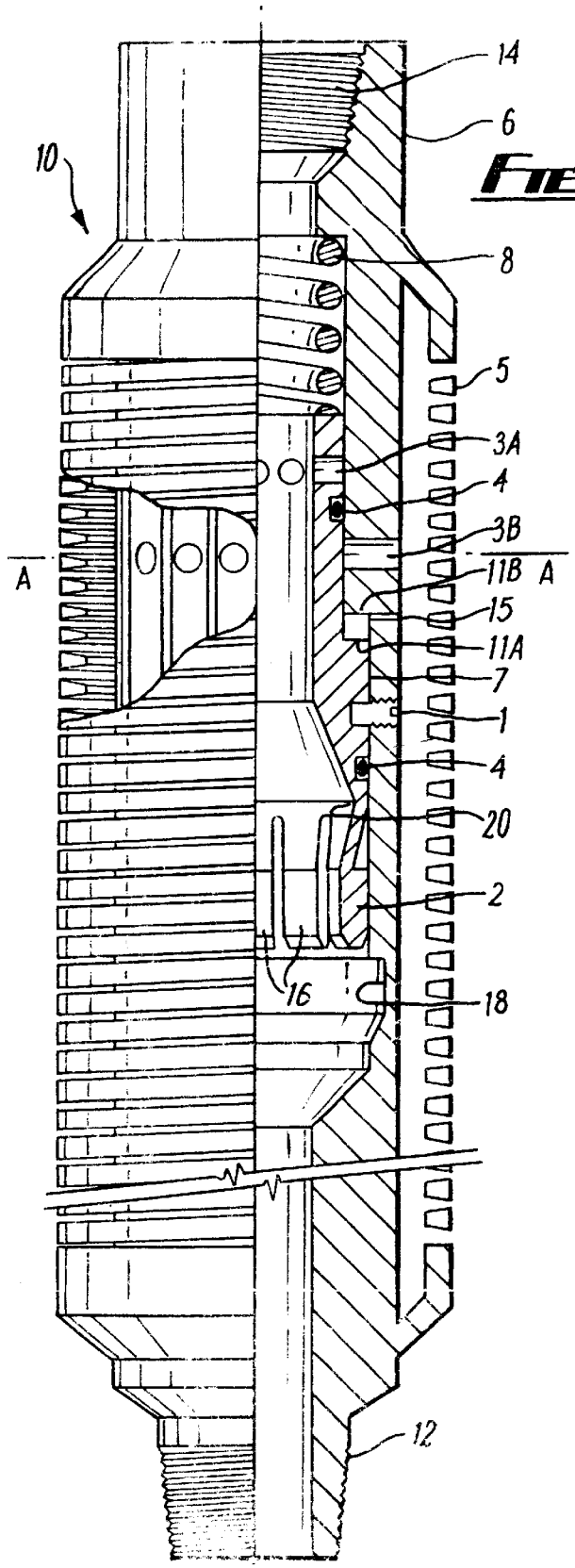
Figure 2:
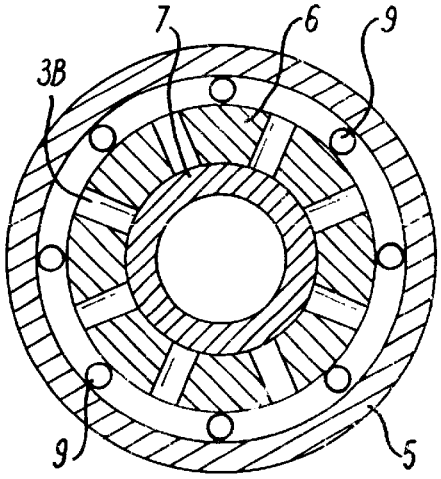
FIG. 2 is a cross-sectional view along section A—A of the tool in FIG. 1.

The downhole tool 10 comprises a body 6 which has conventional pin 12 and box 14 screw threaded connections to provide for inclusion into the production string. A sleeve 7 is located within the inner bore of the body 6, and is initially locked with respect to the body 6 by a shear screw 1 which is known to shear transversely at a certain force. A plurality of ports 3A and 3B are formed in the side walls of the sleeve 7 and body 6 respectively, which are arranged such that when the downhole tool 10 is initially run into the well, the ports 3A and 3B are spaced apart such that there is no fluid path between them. The running in arrangement is shown in FIGS. 1 and 2. Seals 4 ensure the pressure integrity of the downhole tool 10. A spring 8 is located between respective shoulders on the inner bore of the body 6, and the upper face of the sleeve 7, and biasses these shoulders apart.

A screen 5 is located around the outer circumference of the body 6, and is sealed thereto at both ends. The length of the screen 5 can be adjusted prior to insertion into the well depending upon operational requirements, or where the oil and gas payzone is not a sandy formation then the screen can be omitted altogether so that the outer circumference of the body 6, and thus part 3B, are open to the payzone.

A retainer ring 2 is located at the lower end of the sleeve 7. The retainer ring 2 comprises a plurality of collet fingers 16 which are biased outwardly. The retainer ring 2 is optional in certain embodiments of the invention.

Figure 3:
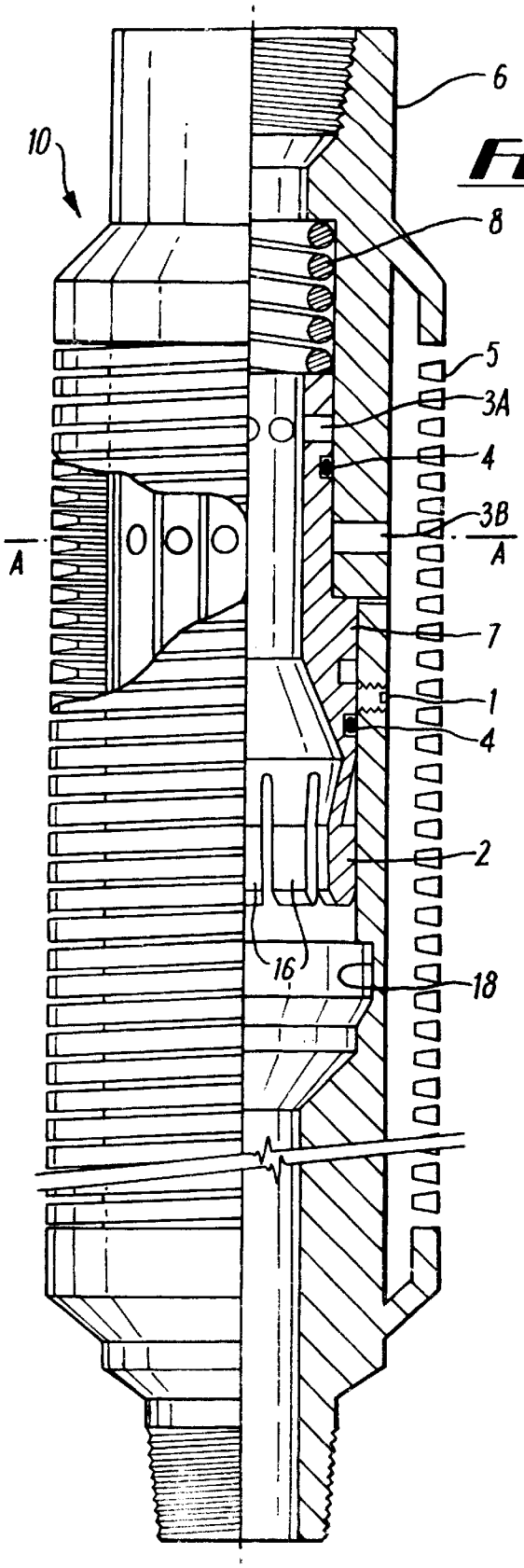
FIG. 3 is a view of the tool in FIG. 1 in a primed configuration.
Figure 4:
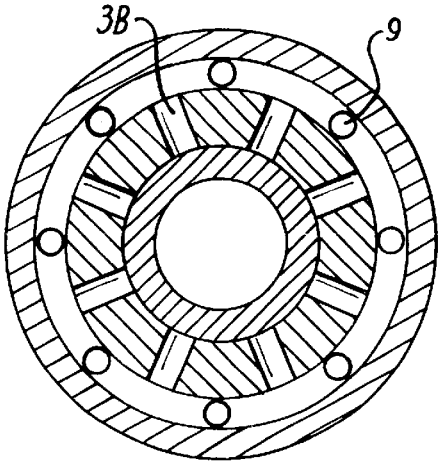
FIG. 4 is a cross-sectional view across section A—A of the tool in FIG. 3.
Figure 5:
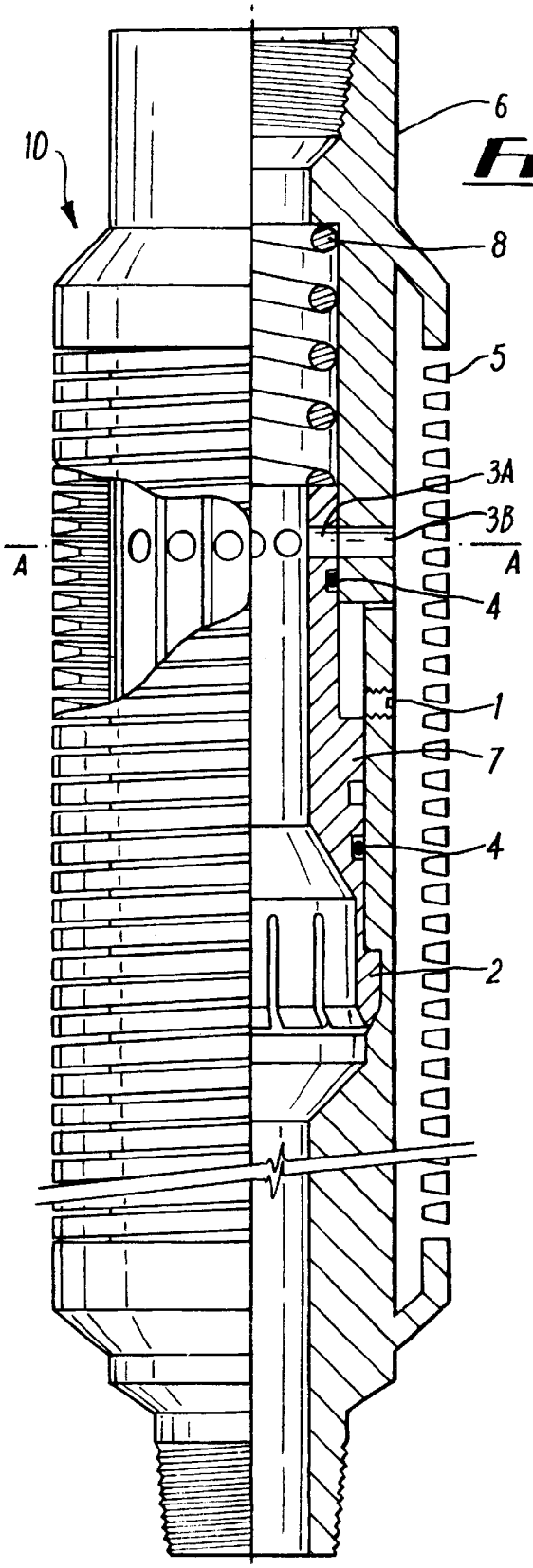
FIG. 5 is a view of the tool in FIG. 1 in an open configuration.
Figure 6:
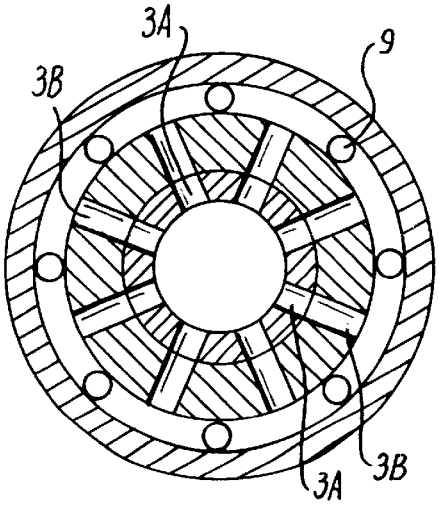
FIG. 6 is a cross-sectional view across section A—A of the tool in FIG. 5.

When a fluid path between the inner bore of the downhole tool 10 and the payzone formation is required, the following sequence of operation is observed. The fluid pressure within the inner bore of the production string and hence within the inner bore of the downhole tool 10 is increased up to, for instance, 2000 psi. In a first scenario, all the downhole tools 10 are provided with shear pins that are designed to shear at 1500 psi. The internal diameter of the sleeve 7 is pressured up and will shear the shear pin 1. The sleeve 7 will continue to move upward until the outwardly and inwardly facing shoulders 11A, 11B of the sleeve 7 and body 6 respectively, make contact. The spring 8 is now further compressed than the degree of compression shown in FIG. 1, and the downhole tool 10 is now in the configuration as shown in FIGS. 3 and 4, which is the primed configuration for the downhole tool 10.

The pressure of the fluid within the production string is then reduced which allows the sleeve 7 to move downwardly due to the biassing action of the spring 8. The sleeve 7 continues its downward path of travel until the collet fingers 16 engage in a finger recess 18 formed on the inner bore of the body 6. The sleeve 7 has fully stroked and the ports 3A and 3B are aligned which provide a fluid path for the production fluids to flow from the payzone formation into the inner bore of the downhole tool 10, and hence into the production string. The downhole tool 10 is now in the open configuration shown in FIGS. 5 and 6.

Support rods 9 are located in the annulus between the screen 5 and the body 6 and prevent the screen 5 from collapsing, and the annulus provides a conduit for the production fluids to flow along the entire length of the screen 5.

A shifting tool formation 20 is formed on the inner bore of the sleeve 7 which can be engaged by a shifting tool (not shown) if for some reason the abovementioned pressuring cycle cannot be achieved. In these circumstances, the shifting tool is lowered down the inner bore of the production string, by for instance a wireline operation, and when engaged with the shifting tool formation 20 can be moved to move the sleeve 7 to the open configuration. Alternatively, or in addition, the sleeve 7 is formed from a material (eg aluminium) which can be dissolved by a fluid (eg acid) if for some reason the abovementioned pressurising cycle cannot be achieved. Dissolution of the sleeve then opens the port 3B to the bore of the body 6.

FIGS. 7 to 18 show a second embodiment of a downhole tool 28, where similar components to the first downhole tool 10 are marked with similar reference numerals. The sleeve 7 of the downhole tool 28 is formed with a conventional continuous "J" slot 24 on its outer circumference, rather than being provided with a retainer ring 2. A "J" slot pin 22 is mounted on the body 6 and engages with the "J" slot 24.

Figure 7:
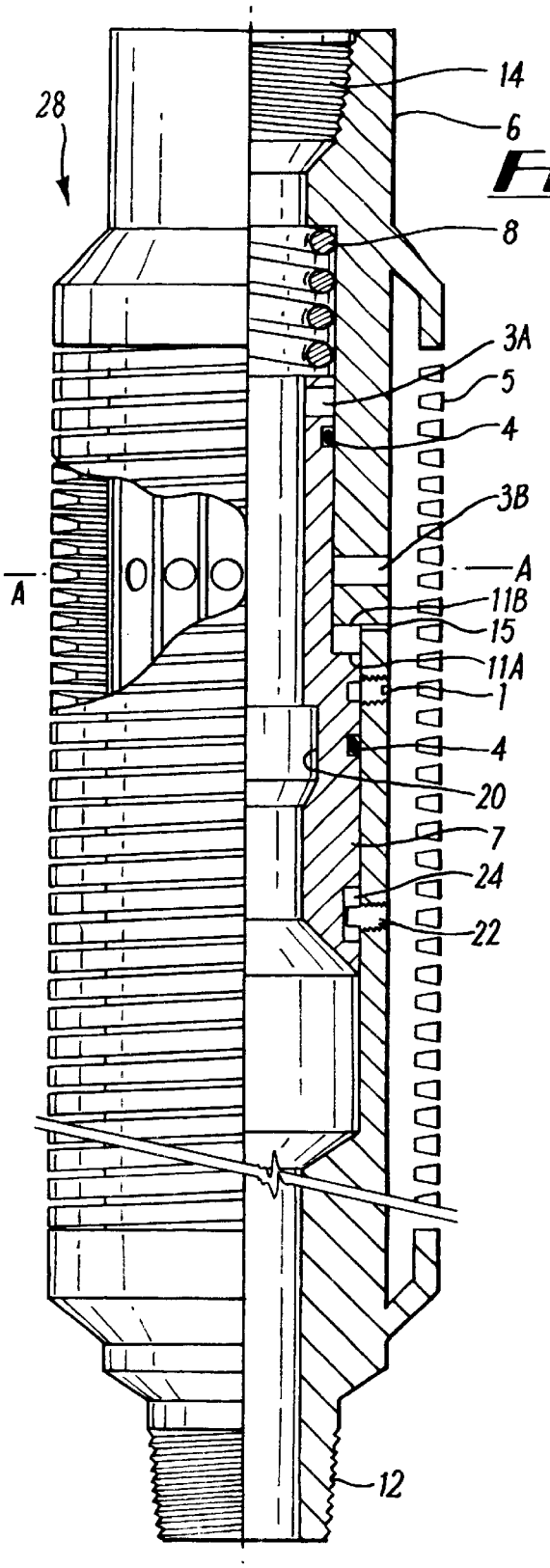
FIG. 7 is a three-quarter sectioned side view of a second example of a downhole tool included in a screen, in a closed and locked configuration.
Figure 8:
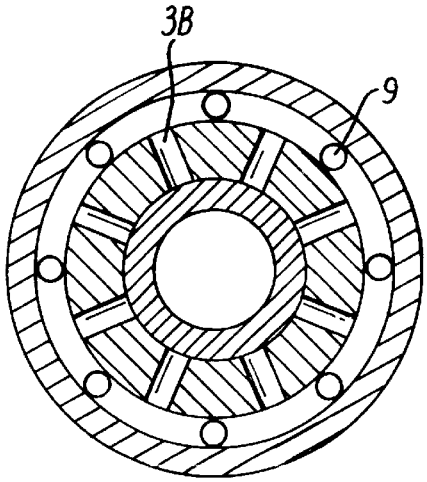
FIG. 8 is a cross-sectional view across section A—A of the tool in FIG. 7.
Figure 9:
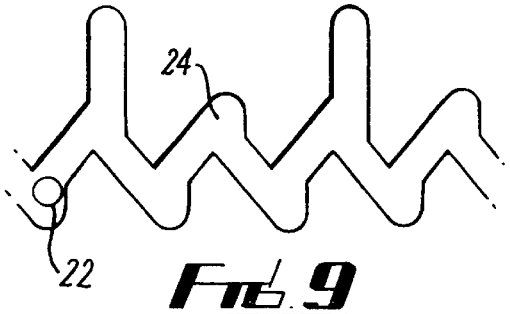
FIG. 9 is a side view of a continuous "J" slot formed on a sleeve of the tool in FIG. 7, laid out flat for greater clarity.
Figure 10:
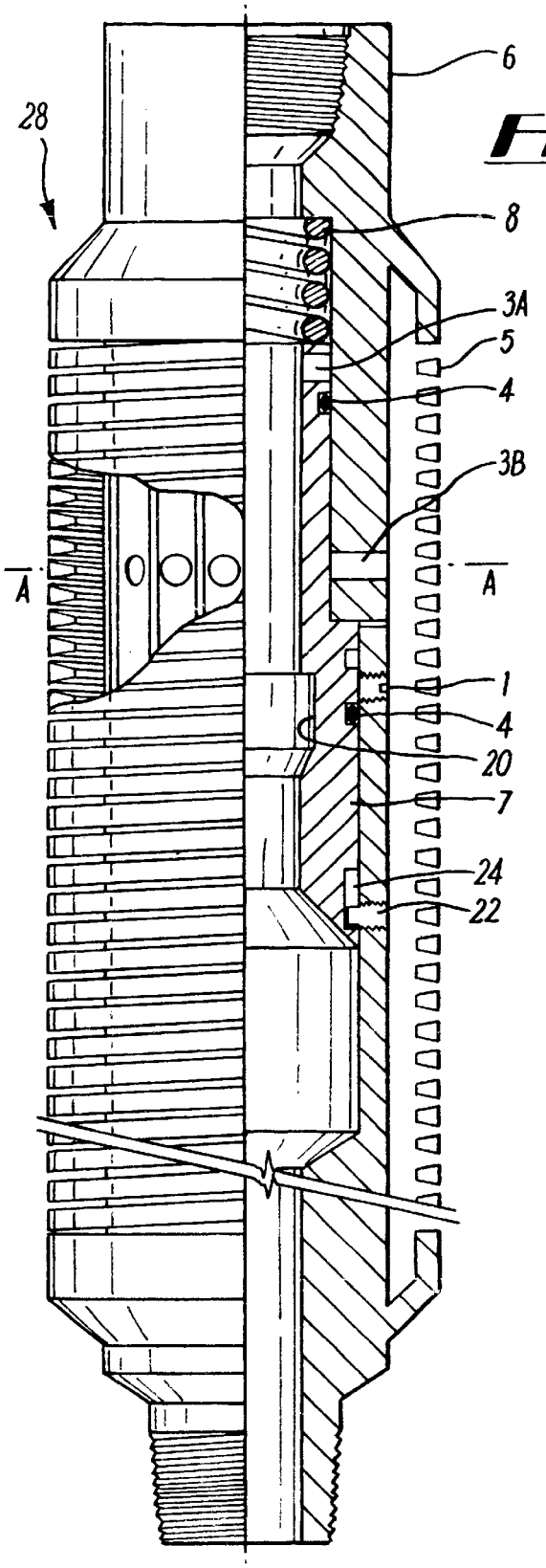
FIG. 10 is a view of the tool of FIG. 7, in a primed configuration.
Figure 11:
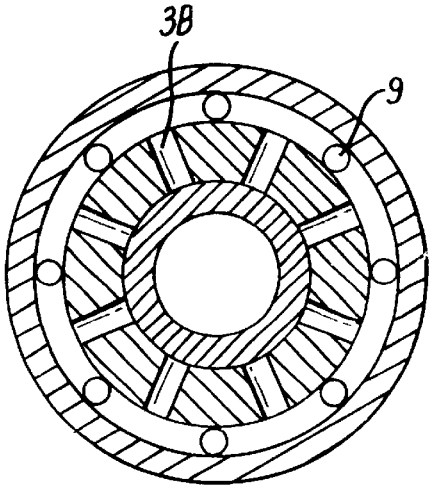
FIG. 11 is a cross-sectional view across section A—A of the tool in FIG. 10.
Figure 12:
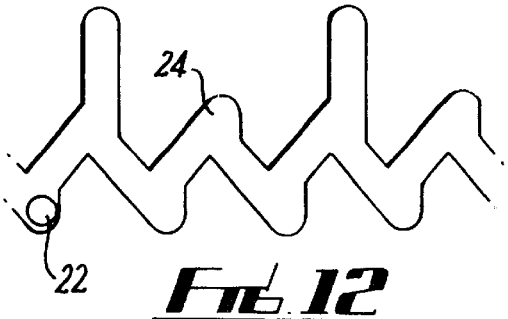
FIG. 12 is a view of the continuous "J" slot of the tool in FIG. 10.
Figure 13:
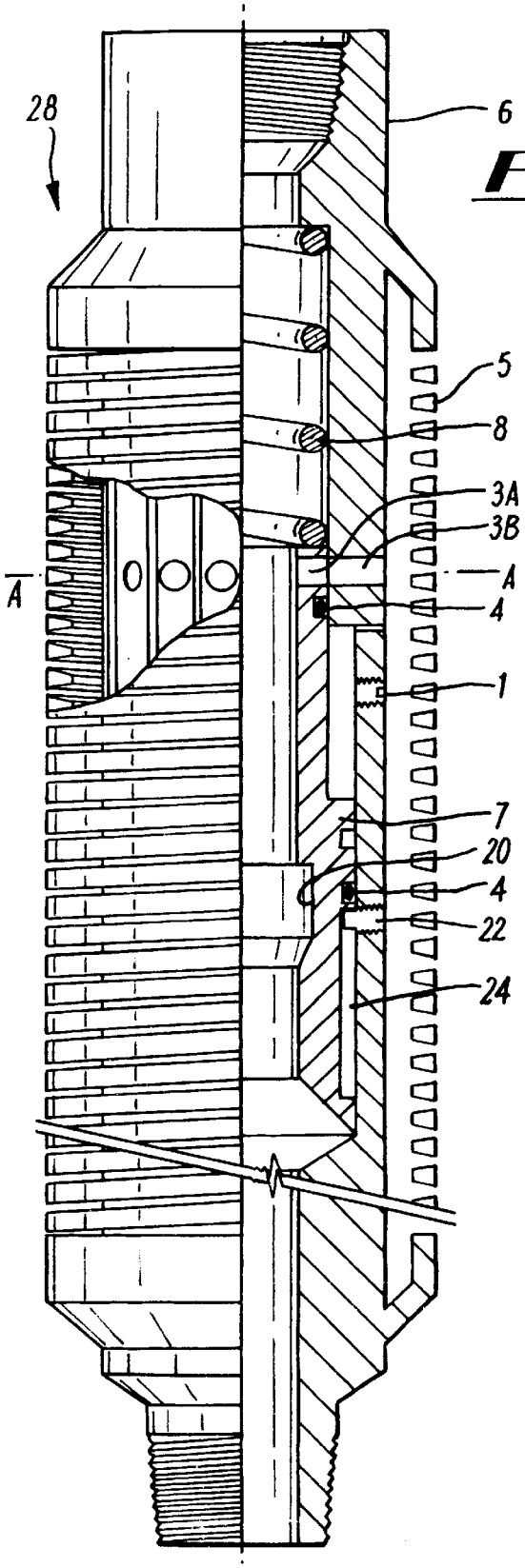
FIG. 13 is a view of the tool of FIG. 10, in an open configuration.
Figure 14:
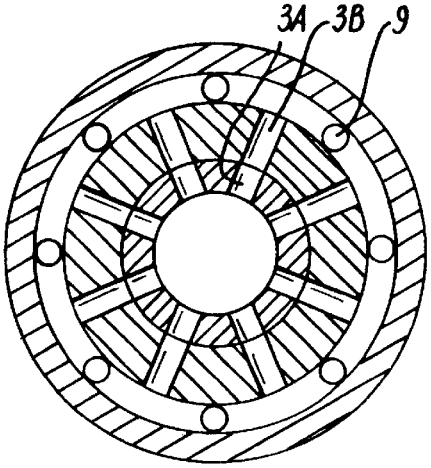
FIG. 14 is a cross-sectional view across section A—A of the tool in FIG. 13.
Figure 15:
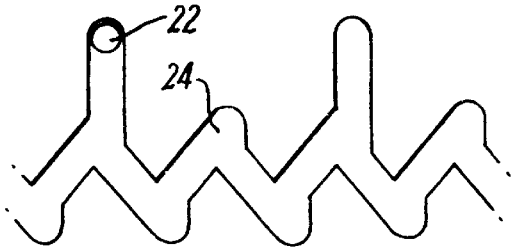
FIG. 15 is a view of the continuous "J" slot of the tool in FIG. 13.
Figure 16:
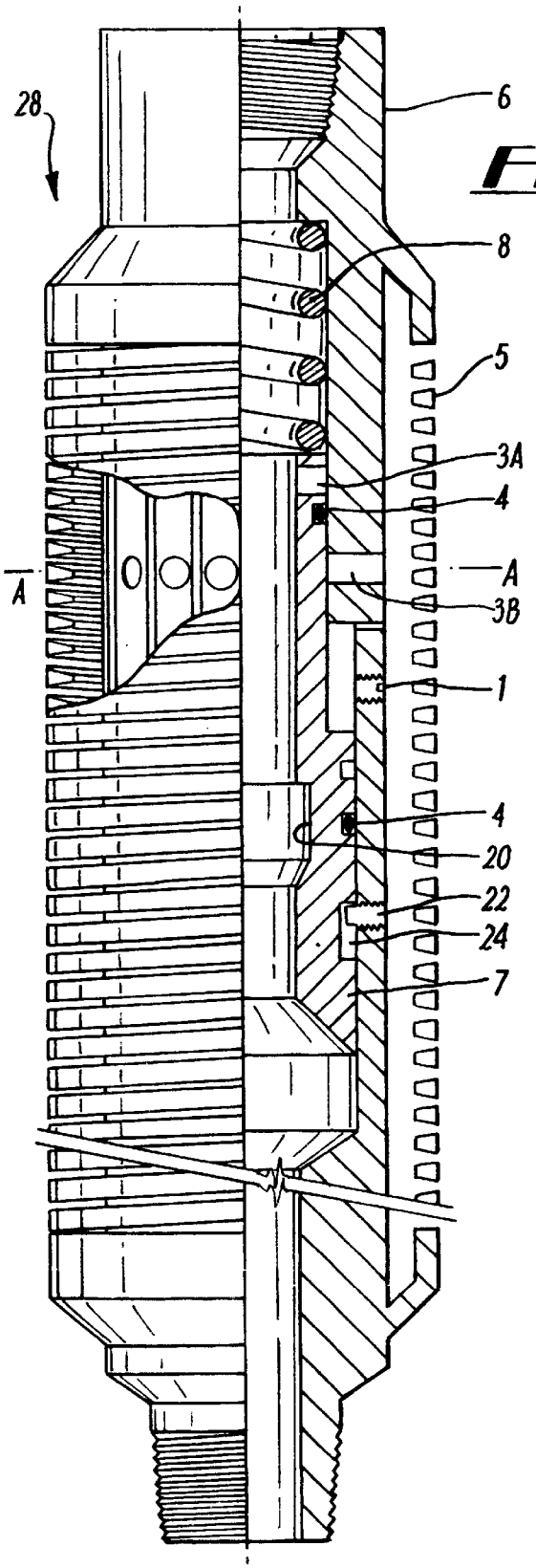
FIG. 16 is a view of the tool of FIG. 10, in a second closed configuration.
Figure 17:
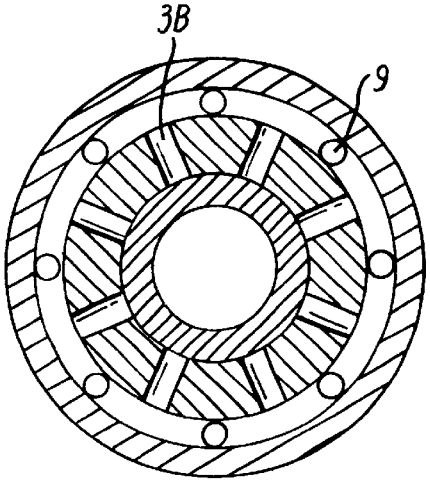
FIG. 17 is a cross-sectional view across section A—A of the tool in FIG. 16.
Figure 18:
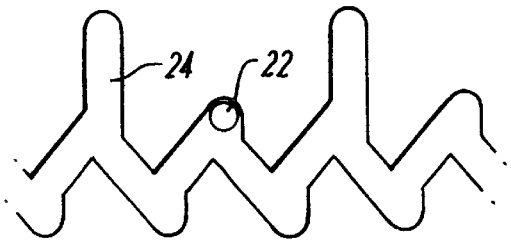
FIG. 18 is a view of the continuous "J" slot of the tool in FIG. 16.

The sleeve 7 of the downhole tool 28 moves upwardly when fluid pressure is increased, breaking the shear pin 1 to move from the running in configuration shown in FIGS. 7, 8 & 9 to the primed configuration shown in FIGS. 10, 11 & 12. When fluid pressure is subsequently decreased, the sleeve 7 moves downwardly under the force of the spring 8, and is caused to rotate by the interaction between the "J" slot pin 22 and the "J" slot 24 until it reaches the open configuration shown in FIGS. 13, 14 & 15. The advantage of providing the sleeve 7 with the "J" slot 24 is that the downhole tool 28 can be cycled through the open and closing operation by engaging a shifting tool (not shown) with the shifting tool formation 20. Thus the downhole tool 28 can be cycled to a second closed configuration shown in FIGS. 16, 17 & 18.

Figure 19:
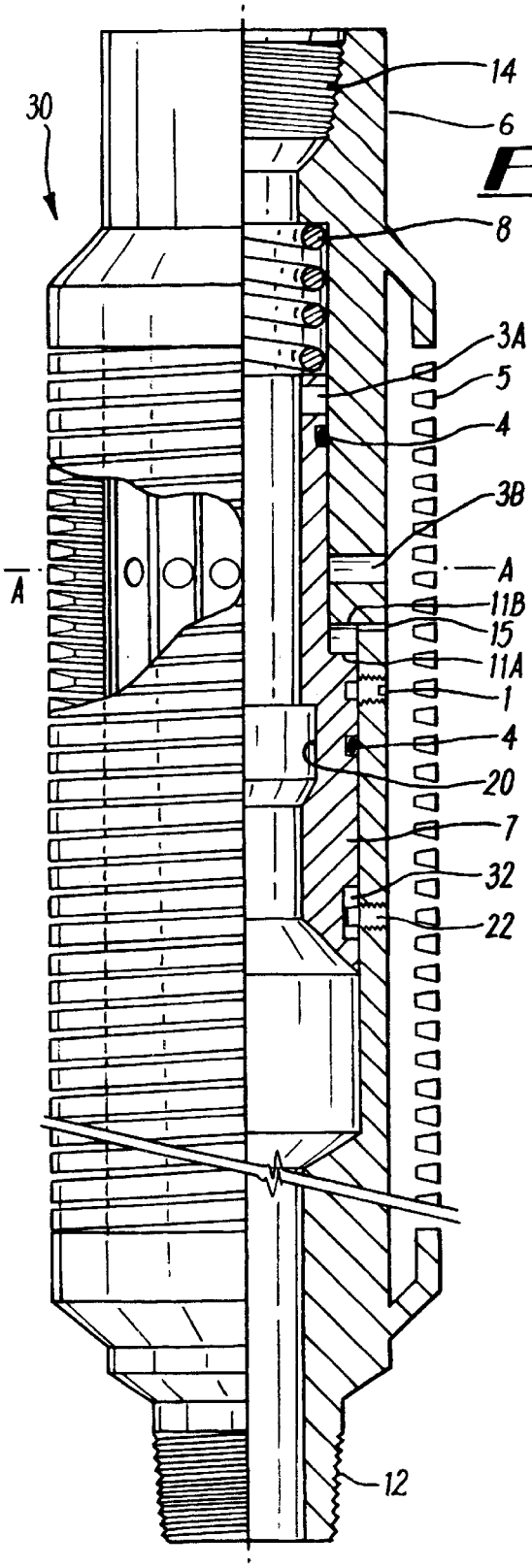
FIG. 19 is a three-quarter cross-sectional side view of a third downhole tool included in a screen, in a closed and locked configuration.
Figure 20:
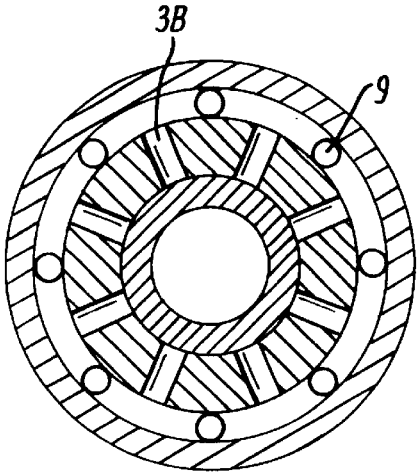
FIG. 20 is a cross-sectional view across section A—A of the tool in FIG. 19.
Figure 21:
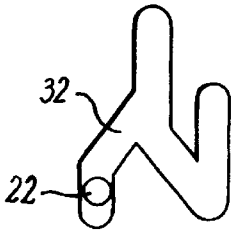
FIG. 21 is a non-continuous "J" slot formed in a sleeve of the tool of FIG. 19, laid out flat for greater clarity.
Figure 22:
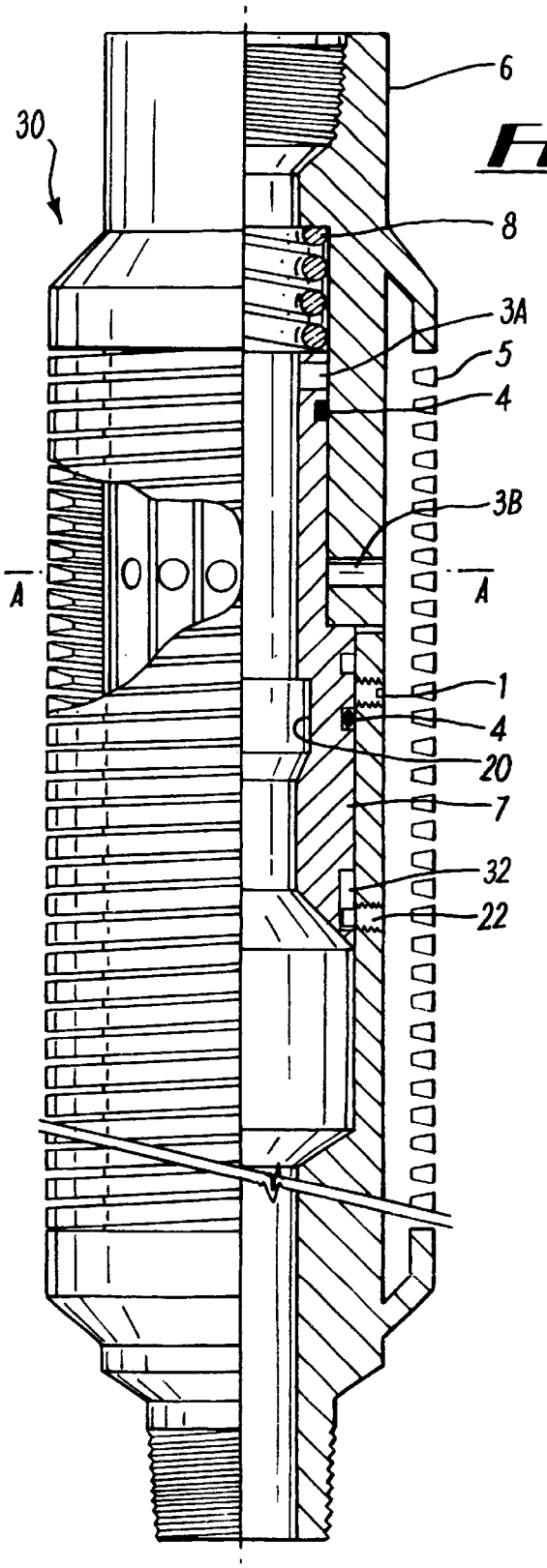
FIG. 22 is a view of the downhole tool of FIG. 19 in a primed configuration.
Figure 23:
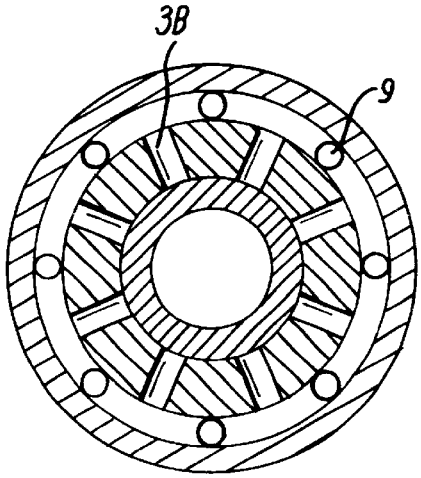
FIG. 23 is a cross-sectional view across section A—A of the tool in FIG. 22.
Figure 24:
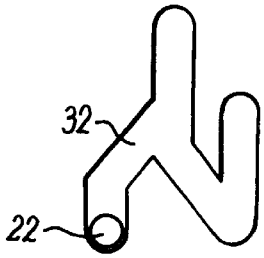
FIG. 24 is a view of the non-continuous "J" slot of the tool in FIG. 22.
Figure 25:
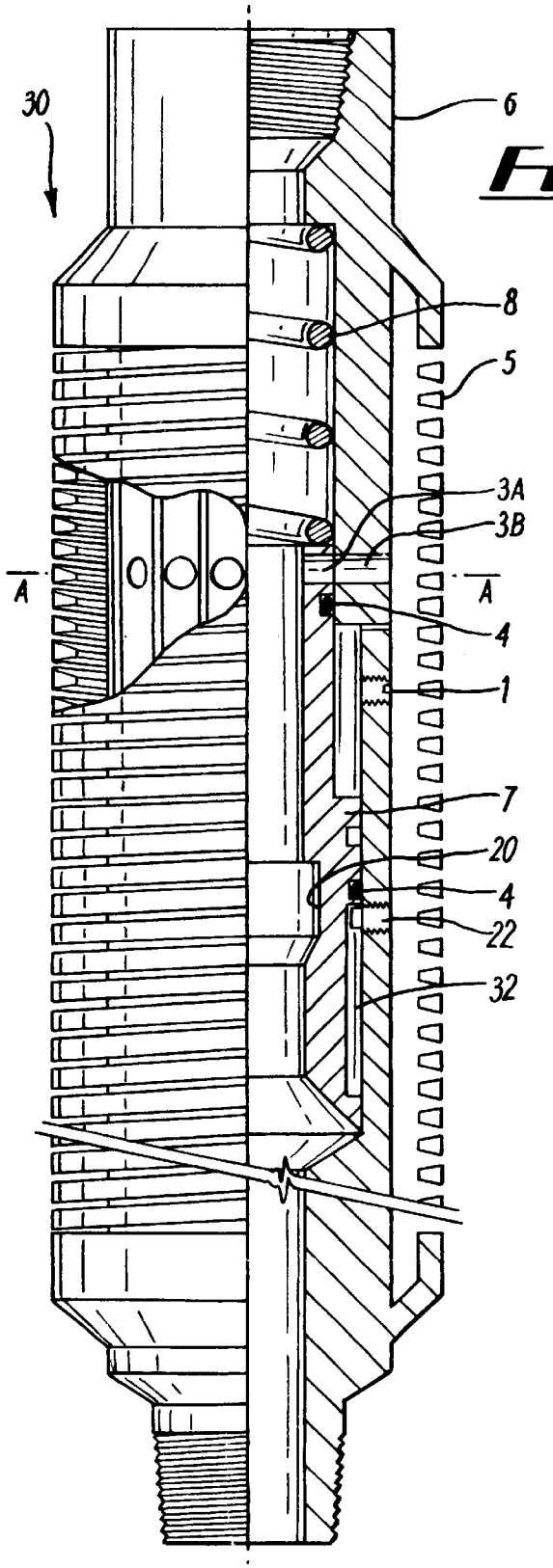
FIG. 25 is a view of the downhole tool of FIG. 19 in an open configuration.
Figure 26:
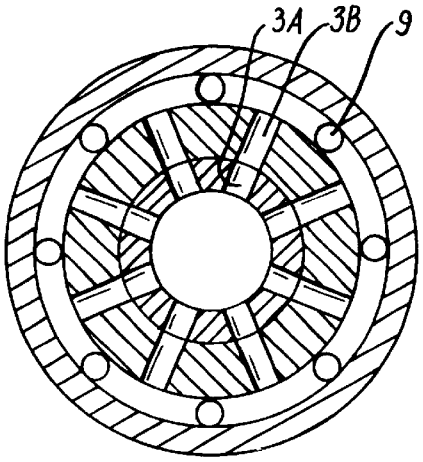
FIG. 26 is a cross-sectional view across section A—A of the tool in FIG. 25.
Figure 27:
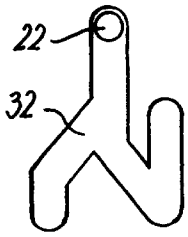
FIG. 27 is a view of the non-continuous "J" slot of the tool in FIG. 25.
Figure 28:
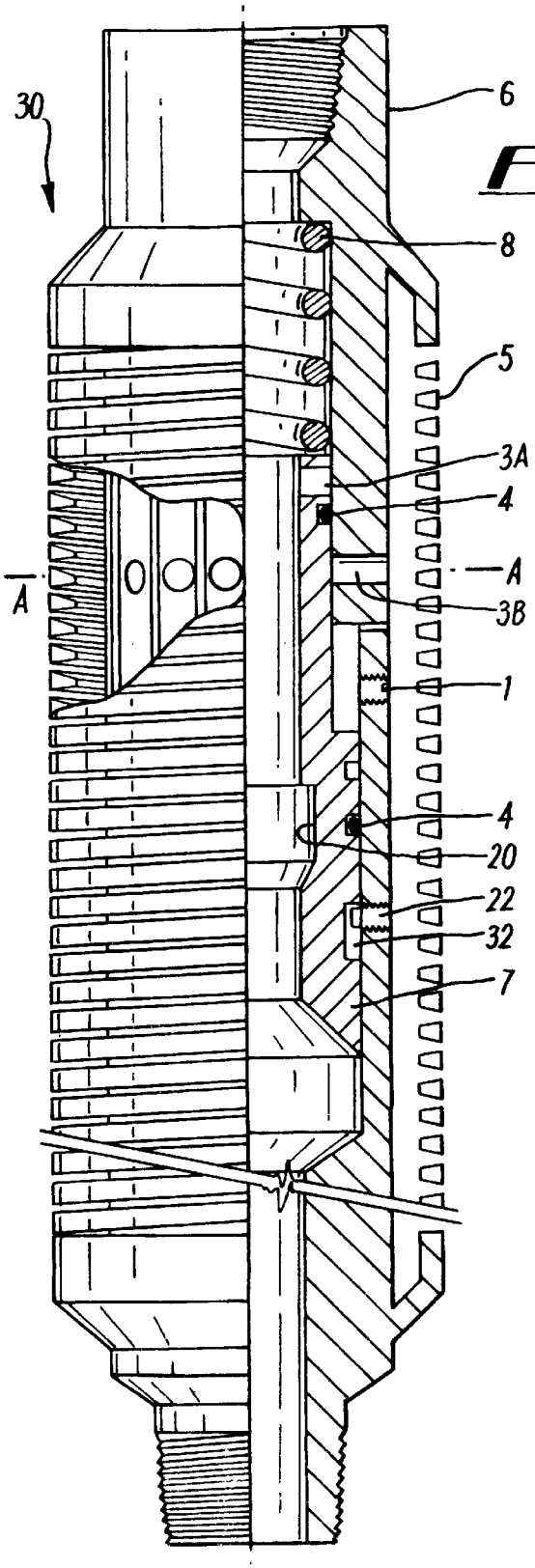
FIG. 28 is a view of the downhole tool of FIG. 19 in a second closed and locked configuration.
Figure 29:
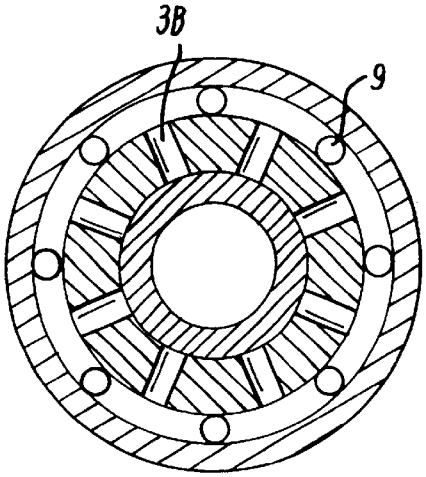
FIG. 29 is a cross-sectional view across section A—A of the tool in FIG. 28.
Figure 30:
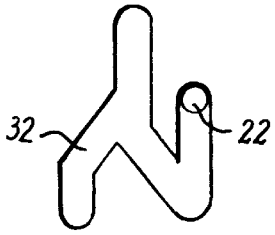
FIG. 30 is a view of the non-continuous "J" slot of the tool in FIG. 28.

A third embodiment of a downhole tool 30 is shown in FIGS. 19 to 28. The third downhole tool 30 differs only from the second downhole tool 28 in that it has a non-continuous "J" slot 32 which is formed around a portion of the outer circumference of the sleeve 7. Hence, the downhole tool 30 is run into the payzone in the closed configuration as shown in FIGS. 19, 20 & 21, until production is required at which point the pressuring up cycle moves the downhole tool 30 into the primed (but still closed) configuration shown in FIGS. 22, 23 & 24. When the fluid pressure is reduced, the downhole tool 30 moves to the configuration shown in FIGS. 25, 26 & 27. However, if it is desired to close the production fluid pathway through the ports 3A, 3B then a shifting tool formation 20 to move the sleeve 7 downwardly with respect to the body 6. The sleeve 7 is locked by the "J" slot pin 22 and the non-continuous "J" slot 32, whereby the downhole tool 30 is as shown in FIGS. 28, 29 & 30 and is in a locked and closed configuration.

Figure 31:
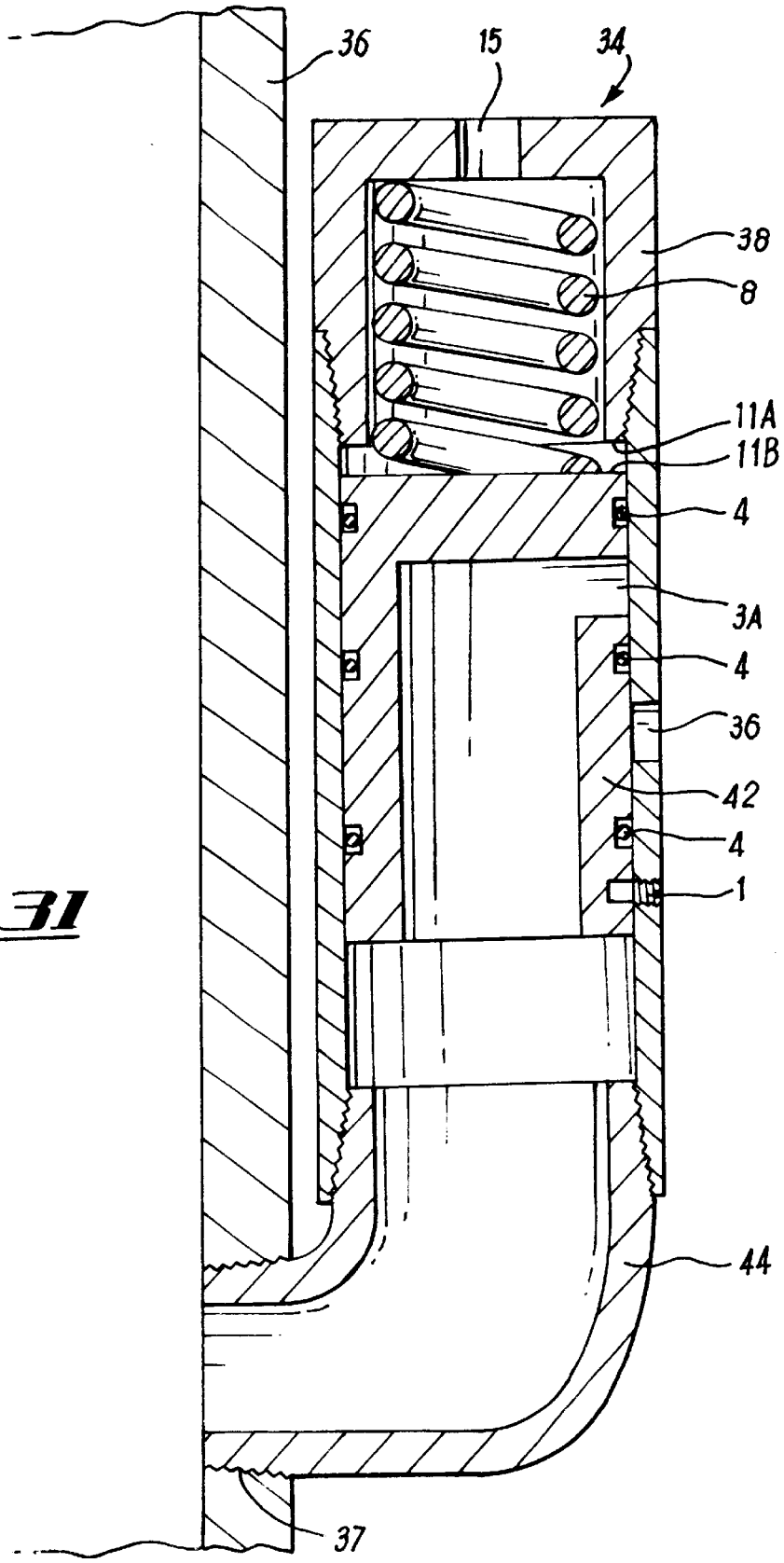
FIG. 31 is a cross-sectional side view of a fourth example of a downhole tool, screwed into a hole of a holed casing, where the downhole tool is in a closed and locked configuration.
Figure 32:
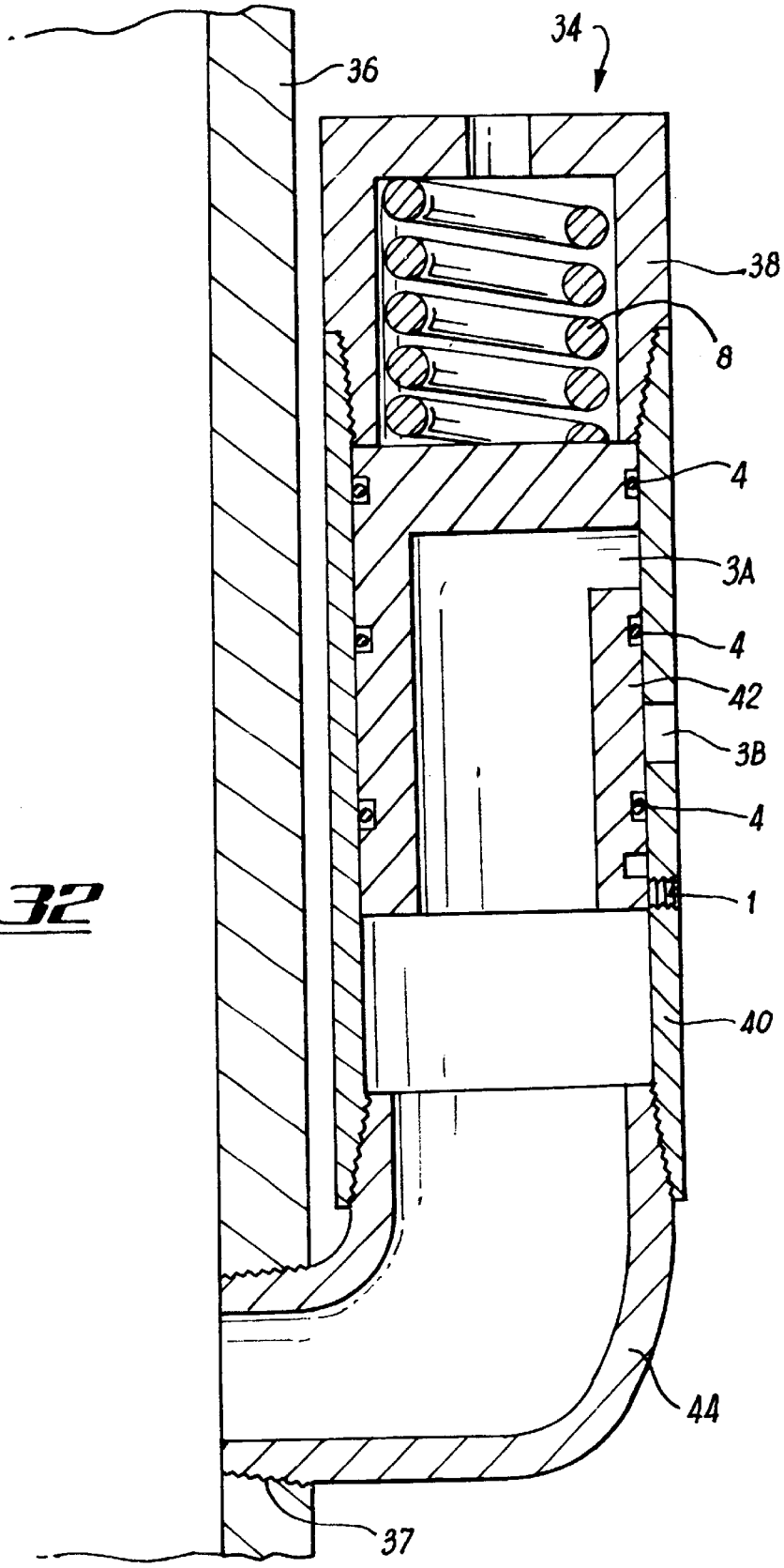
FIG. 32 is a side view of the downhole tool of FIG. 31, in a primed configuration.
Figure 33:
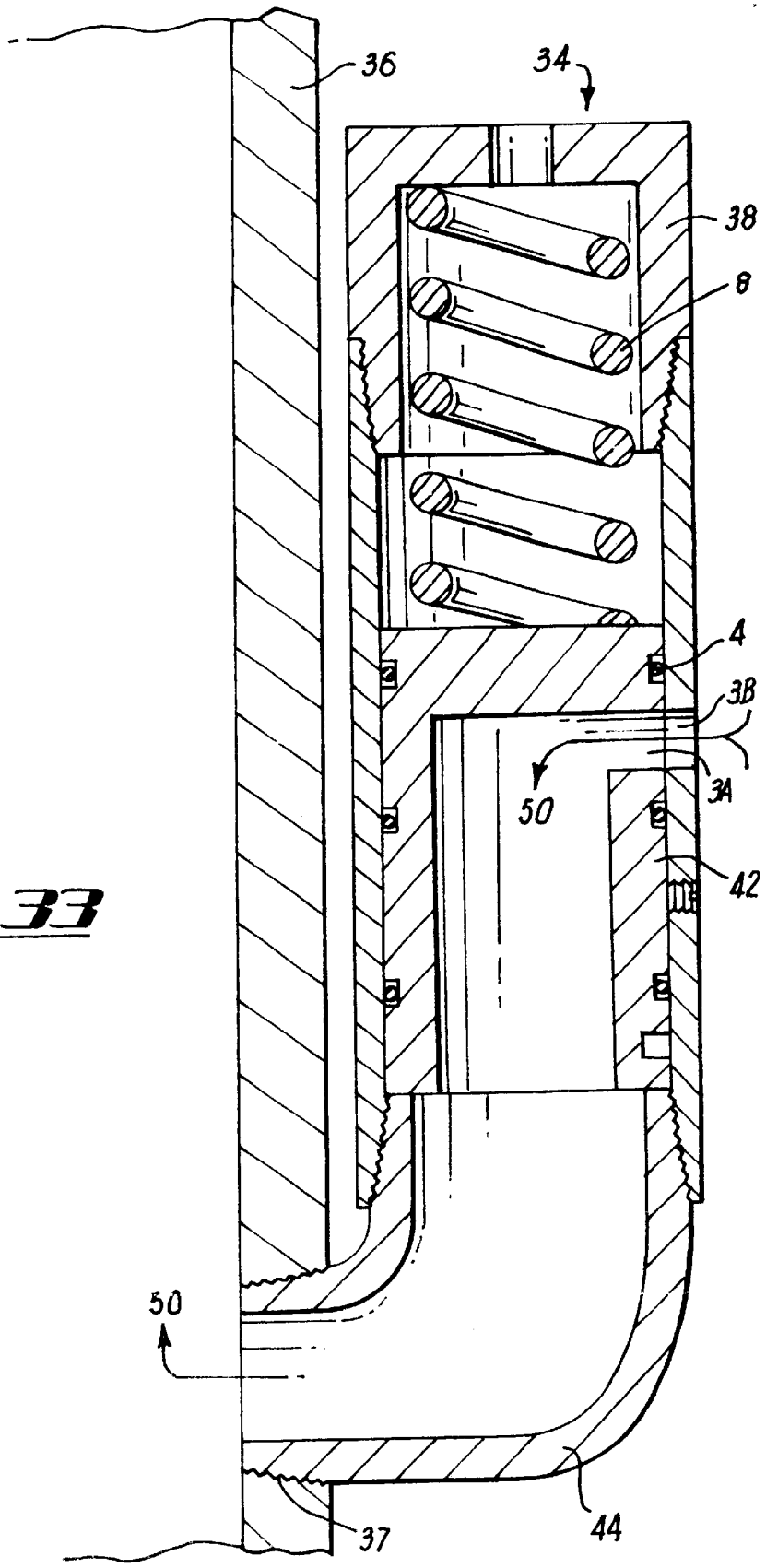
FIG. 33 is a side view of the downhole tool of FIG. 31 in an open configuration.
Figure 34:
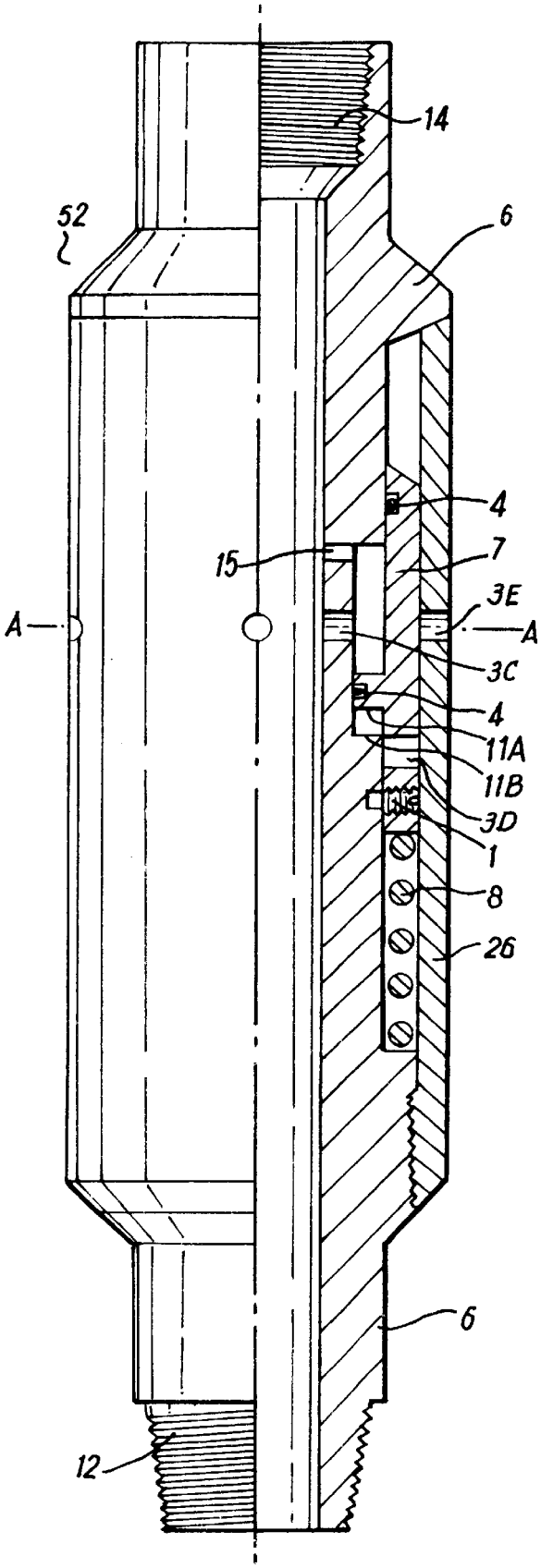
FIG. 34 is a three-quarter cross-sectional side view of a fifth example of a downhole tool in a closed and locked configuration.
Figure 35:
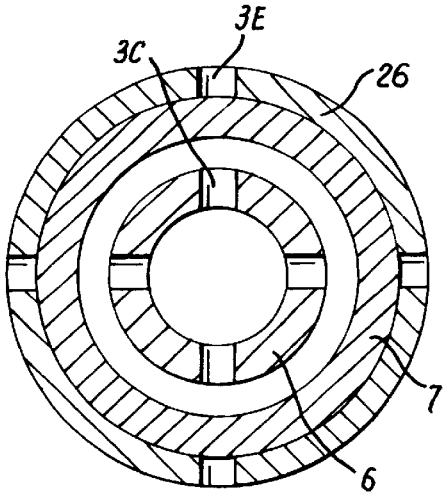
FIG. 35 is a cross-sectional view across section A—A of the downhole tool in FIG. 34.

FIGS. 31, 32 & 33 show a fourth embodiment of a downhole tool 34 for use with conventional pre-holed casing 36. The downhole tool 34 is attached to a screw threaded hole 37 of the pre-holed casing 36 by a right-angled connector 44. A downhole tool 34 would be used with each hole 37 in the pre-holed casing 36.

The downhole tool 34 comprises a cylinder 40 with a port 3B in its side wall. A movable sleeve 42 is located within the cylinder 40 and is slidable with respect thereto, but is initially locked by a shear screw 1. A number of seals 4 seals the movable sleeve 42 to the cylinder 40. A cap 38 is mounted on the upper end of the cylinder 40, and contains a spring 8. The inner bore of removable sleeve 42 is connected to a port 3A. Thus, the downhole tool 34 operates in much the same way as the first 10, second 28 and third 30 downhole tools. When the pressure within the casing 36 is increased, the sleeve 42 is forced upwardly which breaks the shear screw 1 and subsequently further compresses the spring 8. The downhole tool 34 has thus moved from the run-in configuration shown in FIG. 31 to the primed configuration shown in FIG. 32. When the pressure within the casing 36 is reduced, the sleeve 42 moves downwardly due to the biassing action of the spring 8, from the primed configuration to the open configuration shown in FIG. 33, such that the ports 3A and 3B are aligned. Thus, production fluid can flow from the payzone formation in the direction of arrows 50 into the inner bore of the casing 36.

The fourth downhole tool 34 has the advantage that it is simply screwed into the holes of conventional pre-holed casing to provide a selective opening of the production fluid path. It is envisaged that conventional centralisers would be mounted on the casing 36 in order to centralise the casing 36 to protect the downhole tools 34 as they are run into the well.

Figure 36:
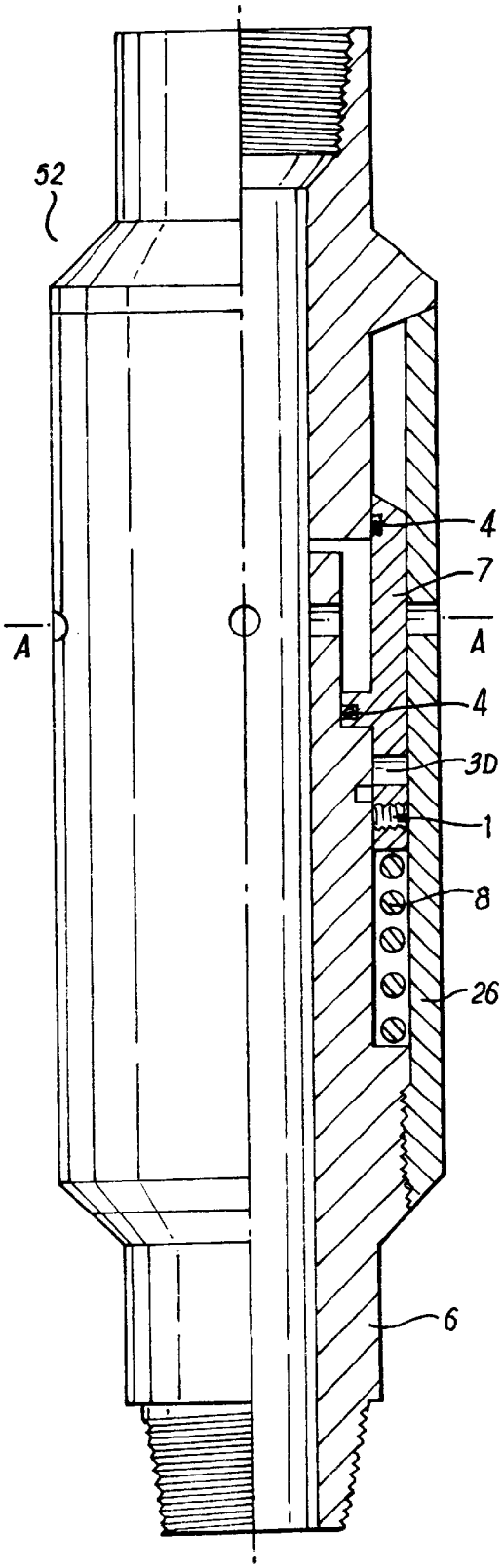
FIG. 36 is a side view of the downhole tool of FIG. 34 in a primed configuration.
Figure 37:
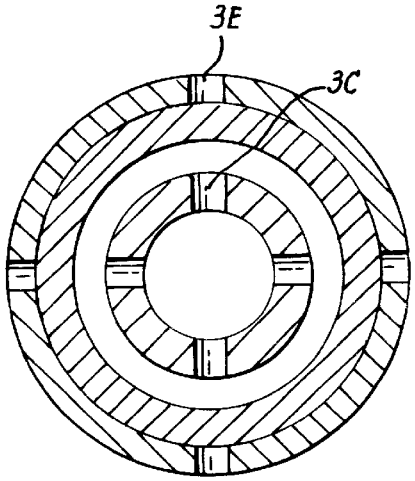
FIG. 37 is a cross-sectional view across section A—A of the tool in FIG. 36.
Figure 38:
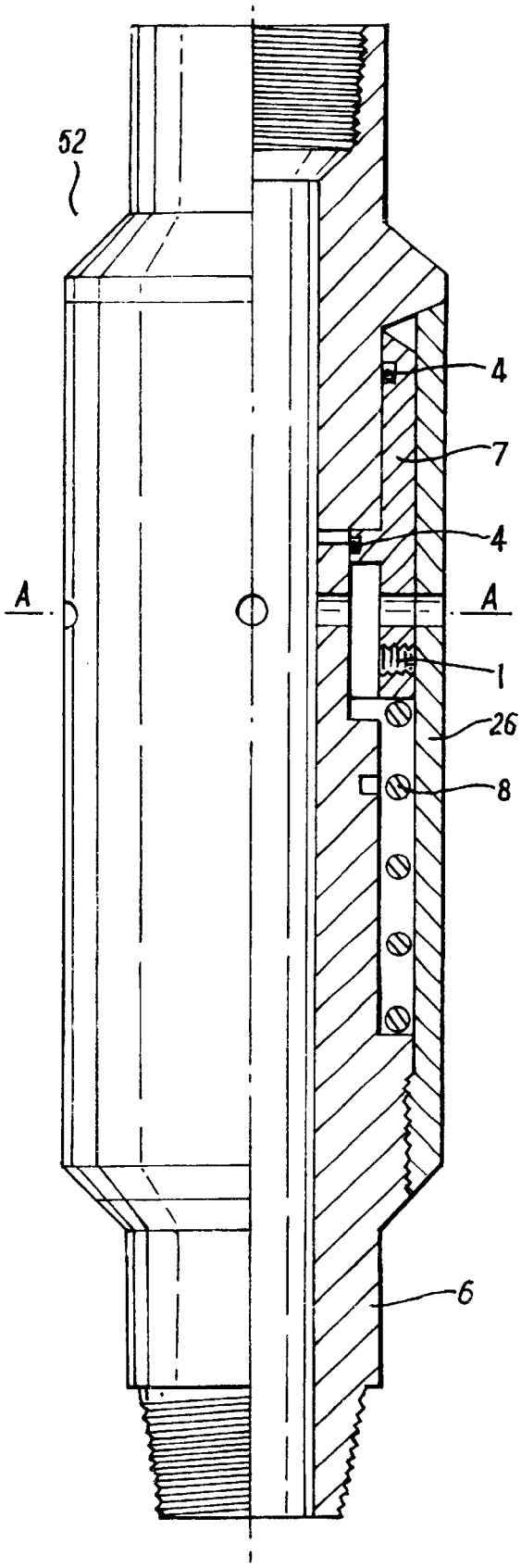
FIG. 38 is a side view of the downhole tool of FIG. 34 in an open configuration.
Figure 39:
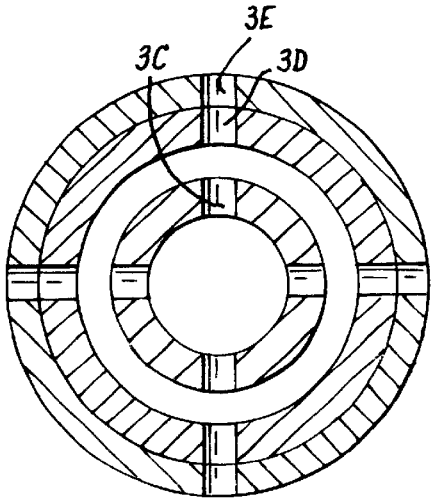
FIG. 39 is a cross-sectional view across section A—A of the downhole tool in FIG. 38.

FIGS. 34 to 39 show a fifth embodiment of a downhole tool 52 which is broadly similar in terms of operation to the first downhole tool 10. However, the sleeve 7 of the downhole tool 52 is situated on the outer circumference of the body 6 and an outer cylinder 26 is screwed onto the outer circumference of the body 6, the outer cylinder protecting the sleeve 7 and associated components. The body 6 and the outer cylinder 26 combined define one body member. The sleeve is again restrained by a shear screw 1 in the run-in configuration shown in FIGS. 34 & 35. When the fluid pressure within the inner bore of the body 6 is increased, it is applied to the sleeve 7 through the inner port 3C, and forces the sleeve 7 downwardly to break the shear screw 1. The sleeve 7 continues downwardly until shoulders 11A and 11B make contact. This stage is shown in FIGS. 36 & 37. When the fluid pressure is reduced, the sleeve 7 is moved upwardly by the biassing action of the spring 8 until it reaches the configuration shown in FIGS. 38 & 39, such that the ports 3C, 3D and 3E in the body 6, sleeve 7 and outer cylinder 26 respectively are aligned and allow fluid flow of production fluids to occur.

The downhole tools 10, 28, 30 34 and 52 are provided with fluid escape ports 15, as appropriate, to ensure that movement of the sleeve 7, 42 is not prevented by trapped fluid.

An advantage providing by the invention is that by providing a plurality of particular downhole tools as described in a horizontally drilled formation payzone, it is virtually assured that all the ports will open at the same time in a controlled manner. Further, by providing different downhole tools in the same production string with different strength shear screws 1, the ports can be opened in the different downhole tools at different times. This provides for the production of an "intelligent" well. This would be achieved by straddling the ports of the downhole tools that have already been opened with two conventional packers joined by an inner string, such that the pressure can again be increased within the inner bore of the production string. Alternatively, the downhole tools not required to be opened could be straddled, so that the rest of the downhole tools are opened.

Further, when drilling through horizontal wells, there may be fractures within the well, which means that water may ingress into the well. Therefore there is a requirement to pack off either side of the fracture with conventional packers and run a non-holed section of casing to straddle the fracture. By utilising the downhole tools of the present invention, either side of a non-holed pipe, it would be possible to inflate the packers without having to use conventional straddle tools to locate fluid into the fluid inlet of the packer. For instance, if a conventional packer requires 1000 psi to inflate, then the downhole tools of the described embodiments could be provided with shear pins that shear at 1500 psi. Therefore, the packer would inflate before the shear pins break and the ports are opened.

Further, by using an inner string to locate cement into the fluid inlet of the packers, conventional straddle tools are again not required since the cement can be flushed out of the well before performing a circulating operation which can achieve high turbulent flow rates, since the ports have not opened yet.

Further, screens can be combined with the downhole tool of the present invention to provide a screen which has selective opening and closing.

Further modifications and improvements may be incorporated without departing from the scope of the invention herein intended.

What is claimed is:

1. A downhole tool for attachment to a production string in a well bore comprising a cylindrical body defining a passage axially therethrough, a sleeve located in the passage in the body, and a screen located around the outer circumference of the body, wherein one or more ports are provided in the sleeve and one or more respective ports are provided in the body, wherein the sleeve is slideable within the body between a closed position wherein the ports in the sleeve are not aligned with the ports in the body and there is no fluid path between them, and an open position wherein the ports in the sleeve are aligned with the ports in the body and there is a fluid path between them, wherein the tool further comprises a mechanical bias for continuously biasing the sleeve toward the open position.

2. A downhole tool as claimed in claim 1 wherein the sleeve is moveable under the influence of fluid pressure against and so as to compress the bias.

3. A downhole tool as claimed in claim 1 wherein the mechanical bias is a coil spring.

4. A downhole tool as claimed in claim 1 further comprising a shear member for holding the sleeve in the closed position, wherein the shear member is shearable at a predetermined force achievable by an increase in fluid pressure, wherein when the shear member is sheared the sleeve is moveable within the passage of the body.

5. A downhole tool as claimed in claim 1 further comprising a locking member for locking the sleeve in the open position.

6. A downhole tool as claimed in claim 1 wherein the sleeve may be repeatedly moved between the open and closed positions by variations in the downhole fluid pressure.

7. A downhole tool as claimed in claim 1 wherein the sleeve is made from a dissolvable material.

* * * * *